US007623144B2

(12) United States Patent
Fotland et al.

(10) Patent No.: US 7,623,144 B2
(45) Date of Patent: Nov. 24, 2009

(54) APPARATUS FOR ELECTROSTATIC IMAGING

(75) Inventors: Richard Fotland, Palo Alto, CA (US); Eric Hanson, Palo Alto, CA (US); Napolean Leoni, Palo Alto, CA (US); Paul McClelland, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 396 days.

(21) Appl. No.: 11/699,720

(22) Filed: Jan. 29, 2007

(65) Prior Publication Data

US 2008/0180510 A1 Jul. 31, 2008

(51) Int. Cl.
*B41J 2/415* (2006.01)

(52) U.S. Cl. ..... 347/123; 347/127

(58) Field of Classification Search ..... 347/123, 347/127

See application file for complete search history.

(56) References Cited

U.S. PATENT DOCUMENTS 4,155,093 A 5/1979 Fotland et al.
4,683,482 A 7/1987 Inaba et al.
4,691,213 A 9/1987 Inaba et al.
4,773,971 A 9/1988 Lam et al.
4,879,569 A 11/1989 Kubelik
4,891,656 A 1/1990 Kubelik
5,027,136 A 6/1991 Fotland
5,030,975 A * 7/1991 McCallum et al. ..... 347/148
5,166,709 A 11/1992 Kubelik
5,296,878 A * 3/1994 Hosaka et al. ..... 347/127
5,742,468 A 4/1998 Matsumoto
6,386,684 B1 5/2002 Brennan et al.
2002/0145657 A1 10/2002 Kubelik

FOREIGN PATENT DOCUMENTS

EP 0377208 A 7/1990

* cited by examiner

*Primary Examiner*—Huan H Tran

(57) ABSTRACT

A print head includes a first electrode layer including a plurality of generator electrodes, a second electrode layer including a plurality of discharge electrodes, and an insulating layer disposed between the generator electrodes of the first electrode layer and the discharge electrodes of the second electrode layer. The discharge electrodes include at least one discharge aperture extending therethrough. Each discharge aperture has an undercut region defining a discharge surface spaced from and substantially parallel to an opposed surface of the insulating layer.

22 Claims, 6 Drawing Sheets

APPARATUS FOR ELECTROSTATIC IMAGING

BACKGROUND OF THE INVENTION

The present invention generally relates to image transfer technology and, more particularly, to an apparatus for forming a latent electrostatic image on an imaging surface, and an image transfer device utilizing the apparatus.

As used herein, the term "image transfer device" generally refers to all types of devices used for creating and/or transferring an image in an electrostatic imaging process (also referred to as ion deposition printing, charge deposition printing, ionography, electron beam imaging, and digital lithography, for example). Such image transfer devices may include, for example, laser printers, copiers, facsimiles, and the like.

In an image transfer device using electrostatic imaging, an electrostatic latent image is formed on a dielectric imaging surface by directing beams of charged particles onto an imaging surface. The electrostatic latent image thus formed is developed into a visible image using electrostatic toners or pigments. The toners are selectively attracted to the electrostatic latent image on the imaging surface, depending on the relative electrostatic charges of the imaging surface and toner. The imaging surface may be either positively or negatively charged, and the toner system similarly may contain negatively or positively charged particles. A sheet of paper or other medium is passed close to the imaging surface (which may be in the form of a rotating drum or belt, for example) thereby transferring the toner from the imaging surface onto the paper, thereby forming a hard image. The transfer of the toner may be an electrostatic transfer, as when the sheet has an electric charge opposite that of the toner, or may be a heat transfer, as when a heated transfer roller is used, or a combination of electrostatic and heat transfer. In some imaging system embodiments, the toner may first be transferred from the imaging surface to an intermediate transfer medium, and then from the intermediate transfer medium to a sheet of paper.

The source of the beams of charged particles in an image transfer device using electrostatic imaging is referred to as a charge deposition print head, or simply "print head." The present invention relates to charge deposition print heads of the type wherein selectively controlled electrodes, generally arranged in two or more layers separated by insulating layers, are disposed to define a matrix array of charge generators from which charge carriers are directed at the imaging surface moving along a scan direction past the print head. Such charge deposition print heads allow the matrix of charge generators to form an image of arbitrary length, with high resolution, on the imaging surface as it moves past the print head.

In such charge deposition print heads, generator electrodes on a first side of the insulating layer are activated with an RF signal of up to several thousand volts amplitude, while lesser bias or control voltages are applied to discharge electrodes (sometimes referred to as finger electrodes) on the opposite side of the insulating layer to create localized charge source regions located at or near crossing points between the generator and discharge electrodes. Specifically, the discharge electrodes include apertures at which electrical air gap breakdown between the discharge electrode and the insulator causes generation of electrical charge carriers. The charge carriers escape from the apertures and are accelerated to the imaging surface where the charge is deposited. The print heads may be configured to deposit either positive or negative charge, and the negative charge may consist partly or entirely of either ions or electrons. The print heads are configured so that the charge deposited by each aperture forms a pixel or dot-like latent charge image on the imaging surface as it moves past the print head. Each raster scan of the print head electrodes thus fills a narrow image strip, with the totality of image strips forming an image page.

Observation of the onset of charge particle generation in prior art print heads shows that the voltage required to initiate charge particle generation varies between aperture sites. This results in non-uniform charge particle output between aperture sites, and corresponding non-uniformity in the pixels forming the electrostatic latent image on the imaging surface. Further, at diameters smaller than about 100 microns, the discharge voltage rises and non-uniformity effects become severe. For these and other reasons, prior art charge deposition print heads use a discharge electrode aperture diameter of about 150 microns, thus limiting the capability of printing high resolution or light tones.

SUMMARY OF THE INVENTION

The invention described herein provides a print head for use in an electrostatic imaging process. In one embodiment, the print head comprises a first electrode layer including a plurality of generator electrodes, a second electrode layer including a plurality of discharge electrodes, and an insulating layer disposed between the generator electrodes of the first electrode layer and the discharge electrodes of the second electrode layer. Each of the plurality of discharge electrodes includes at least one discharge aperture extending therethrough. Each discharge aperture has an undercut region defining a discharge surface spaced from and substantially parallel to an opposed surface of the insulating layer.

BRIEF DESCRIPTION OF THE DRAWINGS

Embodiments of the invention will be described with respect to the figures, in which like reference numerals denote like elements, and in which.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
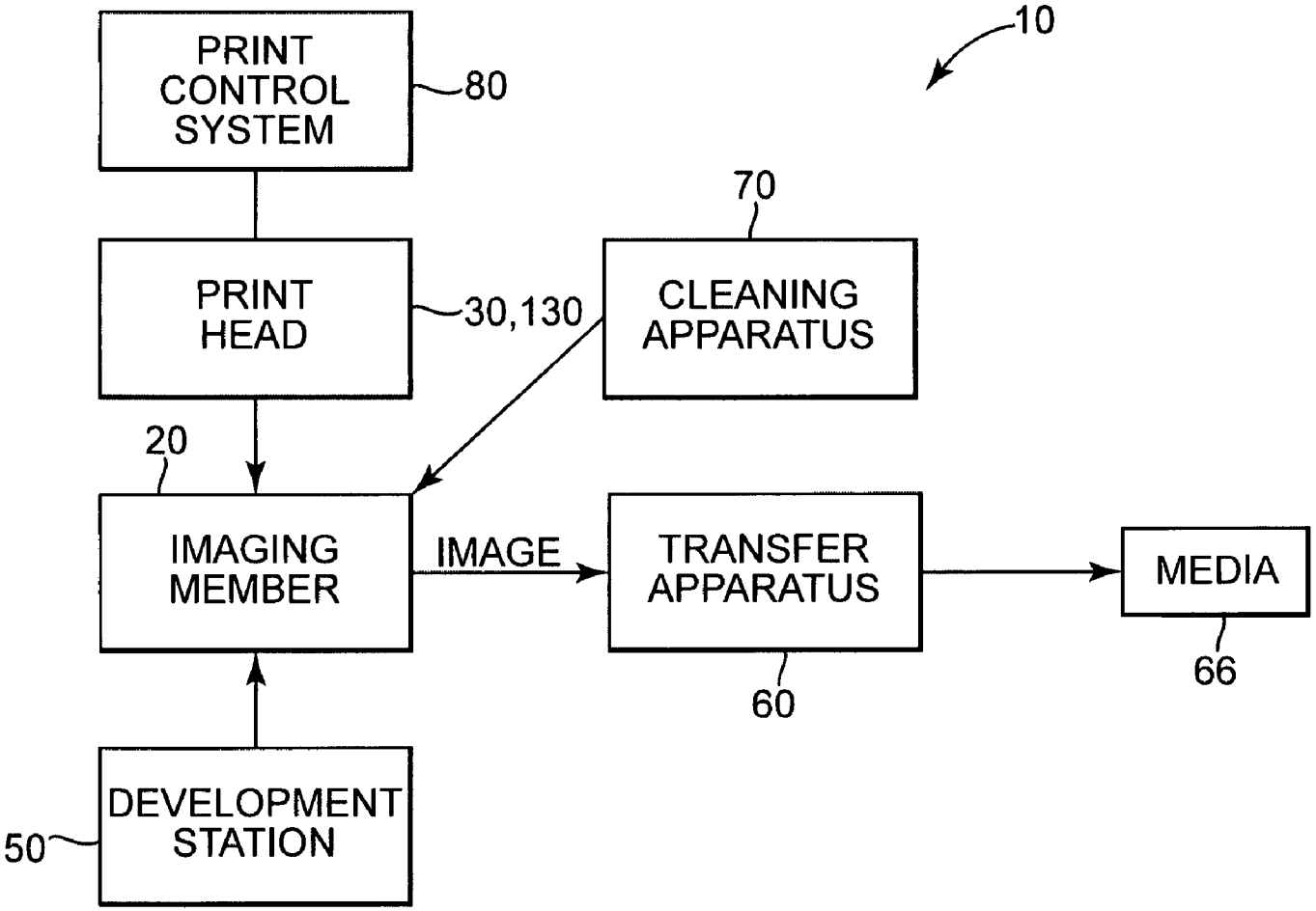
FIG. 1 is a functional block diagram of an image transfer device according to one embodiment.
Figure 2:
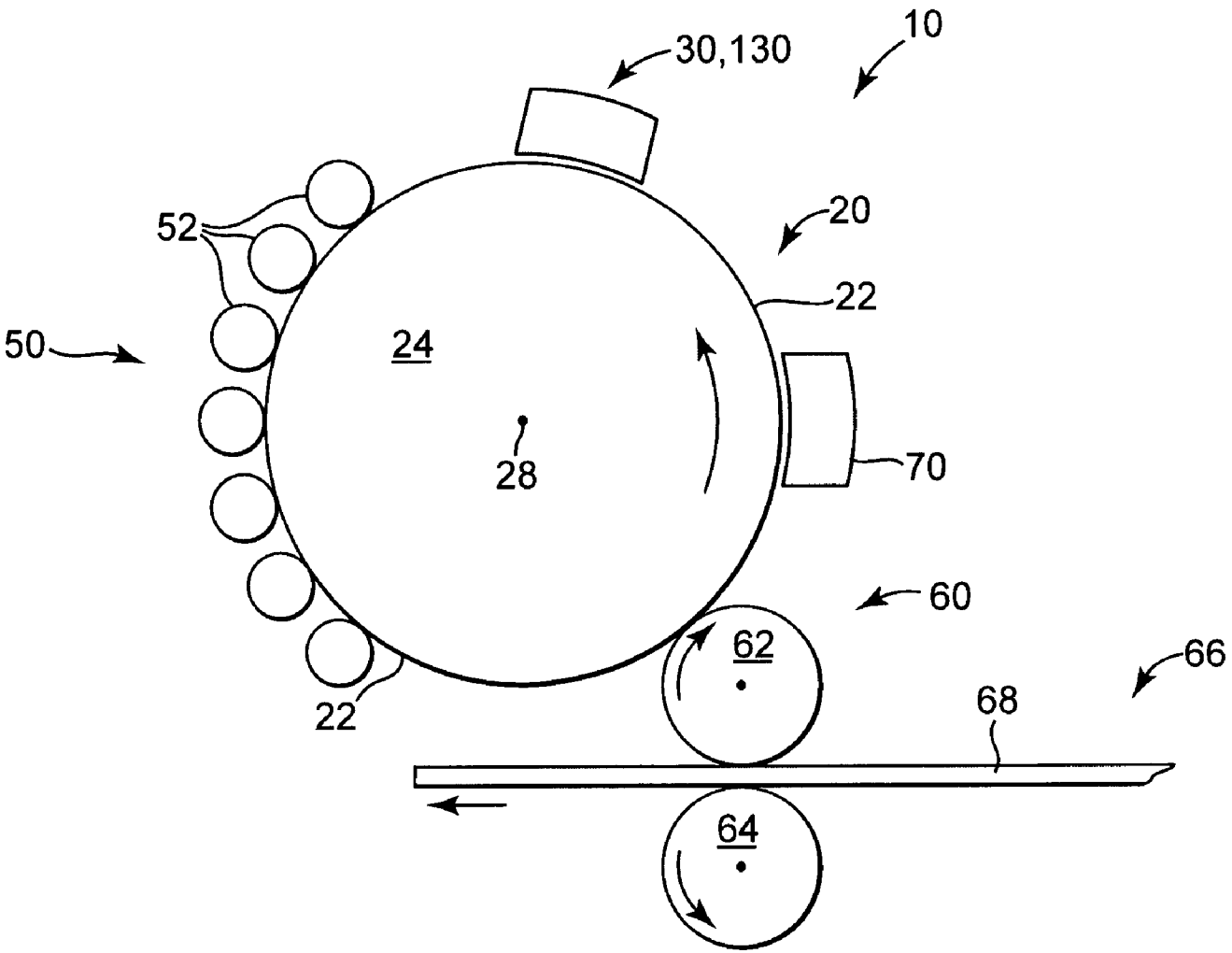
FIG. 2 is a schematic representation of an image transfer device according to one embodiment.

Referring to FIGS. 1 and 2, details regarding an exemplary configuration of an image transfer device 10 configured to implement electrostatic imaging operations according to one embodiment are shown. The depicted image transfer device 10 includes an imaging member 20, a charge deposition print head 30, 130, a development station 50, an image transfer apparatus 60, and a cleaning apparatus 70. Operation of print head 30, 130 is controlled by print control system 80. Other configurations are possible, including more, less, or alternative components.

Imaging member 20 comprises an outer imaging surface 22 and may, for example, be embodied as a drum 24 that rotates about an axis 28, wherein portions of outer surface 22 pass adjacent to print head 30, 130, development station 50, image transfer apparatus 60, and cleaning apparatus 70. Other configurations of imaging member 20 (e.g., a belt or sheet) are possible in other embodiments.

Print head 30, 130 is configured to provide an electrostatic latent image upon the imaging surface 22 of the imaging member 20. The electrostatic latent image is due to a difference in the deposition of charged particles on imaging surface 22, as further described below with reference to FIGS. 3 through 6. In one implementation, print head 30, 130 forms electrostatic latent images on imaging surface 22 corresponding to various colors, for example, yellow (Y), magenta (M), cyan (C) and black (K), respectively.

Development station 50 is configured to provide a marking agent, such as liquid ink in a liquid configuration or dry toner in a dry configuration. The marking agent may be electrically charged and attracted to the locations of the imaging surface 22 corresponding to the electrostatic latent image to thereby develop the latent image and form a visible toner image on imaging surface 22. In one embodiment, development station 50 may include a plurality of development rollers 52 providing marking agents of different colors corresponding to various color images formed by print head 30, 130.

Image transfer apparatus 60 is configured to transfer the marking agent of the developed image formed upon imaging surface 22 to media 66. In one embodiment, image transfer apparatus 60 includes an intermediate transfer drum 62 in contact with imaging surface 22, and a fixation or impression drum 64 defining a nip with transfer drum 62. As transfer drum 62 is brought into contact with imaging surface 22, the marking agent of the developed image is transferred from surface 22 to transfer drum 62. Media 66, such as a sheet of paper 68, is fed into the nip between transfer drum 62 and impression drum 64 to transfer the marking agent defining the image from transfer drum 62 to media 66. Impression drum 64 fuses the toner image to media 66 by the application of heat, pressure, or a combination thereof.

Cleaning apparatus 70 is configured to remove any marking agent which was not transferred from imaging surface 22 of imaging member 20 to transfer drum 62 prior to recharging or imaging surface 22 by print head 30, 130.

Figure 3:
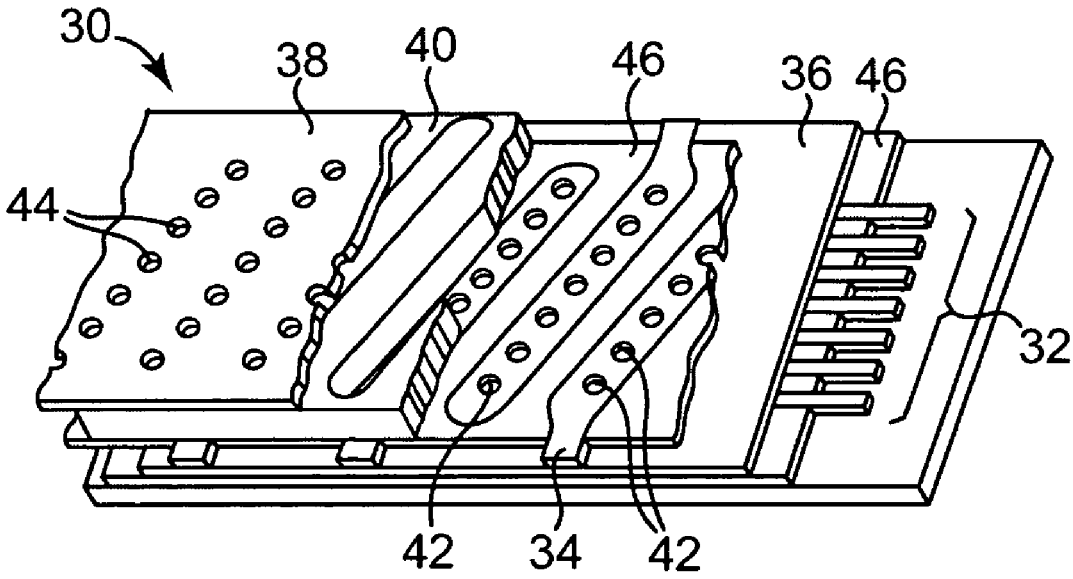
FIG. 3 is a schematic representation of an exemplary charge deposition print head according to one embodiment.

Referring to FIG. 3, a portion of an exemplary charge deposition print head 30 is illustrated. Print head 30 includes a plurality of generator electrodes 32 in a first layer, and a plurality of discharge electrodes 34 in a second layer, where the generator electrodes 32 are separated from the discharge electrodes 34 by a dielectric insulating layer 36. An exemplary insulating layer 36 comprises mica, glass, or silicone film having a thickness on the order of 25 microns. With a typical dielectric constant of 5, the equivalent electrical thickness of the insulating layer 36 is about 5 microns. An optional screen electrode 38 is isolated from the discharge electrodes 34 by a spacer layer 40. The discharge electrodes 34 have discharge apertures 42 passing therethrough which are generally aligned with apertures 44 in the screen electrode 38. Discharge apertures 42 are typically circular in shape. The generator electrodes 32 intersect the discharge electrodes 34 where the discharge apertures 42 are located. Each intersection of a generator electrode 32, a discharge electrode 34 and a discharge aperture 42 form a charge production site for print head 30. The spaces between adjacent generator electrodes 32 and between adjacent discharge electrodes 34 can be filled by a suitable dielectric material 46, for example, spin on glass (SOG).

Figure 4:
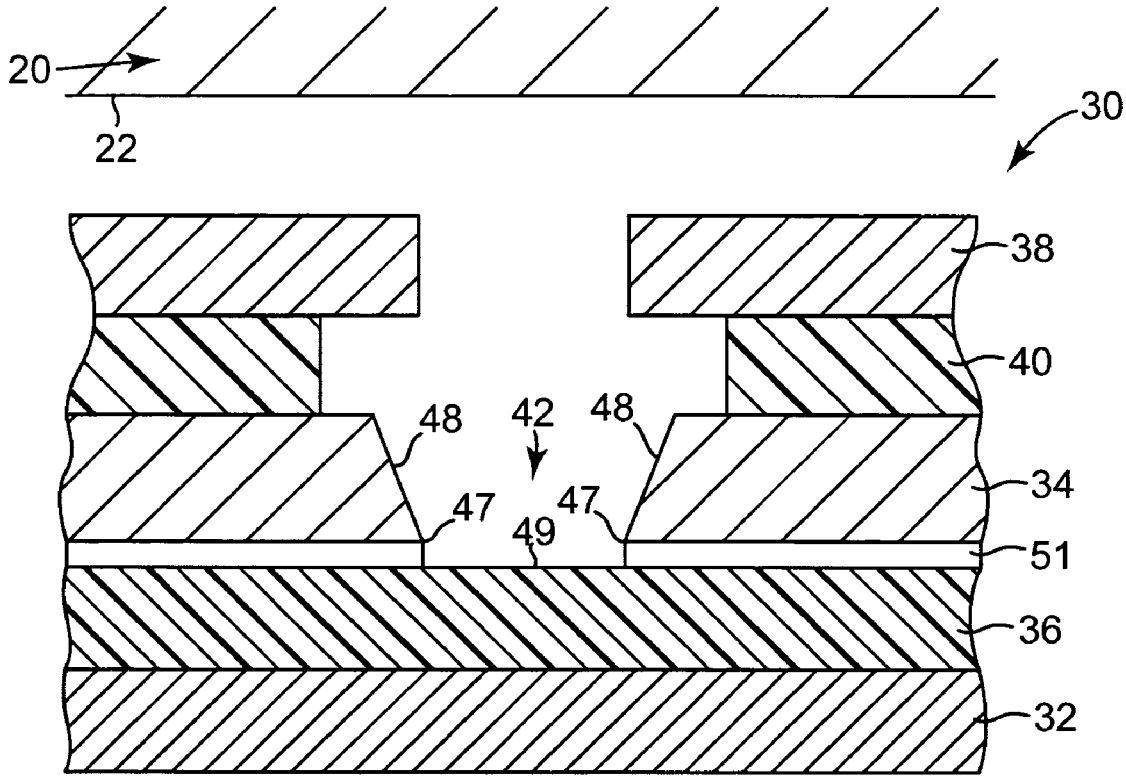
Fig. 4 PRIOR ART
FIG. 4 is a schematic cross-sectional representation of a charge production site of a prior art print head.

Referring to FIG. 4, a cross-section of a single charge production site of a prior art print head 30 is shown. Walls 48 of the discharge apertures 42 are typically tapered so that the external angle formed between the wall 48 of discharge aperture 42 and the surface 49 of the insulating layer 36 range between 90 and 120 degrees, although not limited to this range. The taper of the discharge aperture walls 48 is not limited to being a simple conical taper, but may have other shapes including flared or curved shapes in which the wall angle varies with distance from the insulating layer 36.

If a high voltage is applied to an intersecting pair of generator and discharge electrodes 32, 34, respectively, an electrical breakdown of air inside the associated discharge aperture 42 occurs. The electrical breakdown causes formation of gaseous plasma full of charged ions and electrons. The polarity of particles used for imaging is determined by the polarity of the screen electrode 38 potential with respect to grounded imaging member 20, while the on/off switching of charge emission from the print head 30 is regulated by a difference in electrical potential between the screen electrode 38 and the discharge electrodes 34.

Electrical air gap breakdown for the generation of electrical charge carriers is initiated by the air gap fringing field between the discharge electrode 34 and the insulator 36. The breakdown occurs between two surfaces: the edge 47 or perimeter of discharge aperture 42, and the surface 49 of the insulating layer 36, as shown in FIG. 4. In the embodiment of FIG. 4, spacer layer 51 separates edge 47 and surface 49. The initiating event in the discharge process involves field emission of an electron from the either the discharge electrode 34 or the insulating layer 36. The discharge continues through avalanche charge multiplication even at much lower field strength. In a high frequency field, only one initiation event is required because of the presence of large numbers of ions that appear to have a life on the order of microseconds.

In air at atmospheric pressure, the Paschen minimum voltage for air gap breakdown is about 375 volts at a spacing of about 5 microns (75 volts/micron). At a smaller spacing, the breakdown voltage rises rapidly due to low collision probabilities between charged species and air molecules. At a larger spacing, the breakdown voltage rises to, for example, 500 volts at 40 microns (12 volts/micron) and 1400 volts at 240 microns (6 volts/micron).

One skilled in the art would anticipate that the initiating field for discharge in typical print heads 30 (having an insulating layer 36 with an electrical thickness of about 5 microns, as noted above) would be approximately equal to 75 volt/micron for spacing near the Paschen minimum. However, observed discharge thresholds for prior art print heads 30 are usually in the range of 540 to 640 volts, and observation of the visual onset of discharge shows that the discharge threshold voltage varies between discharge apertures 42. Observed discharge threshold voltages vary over a range of about 100 volts. The variation in discharge threshold voltage results in non-uniform charged particle output between discharge apertures 42.

Figure 5A:
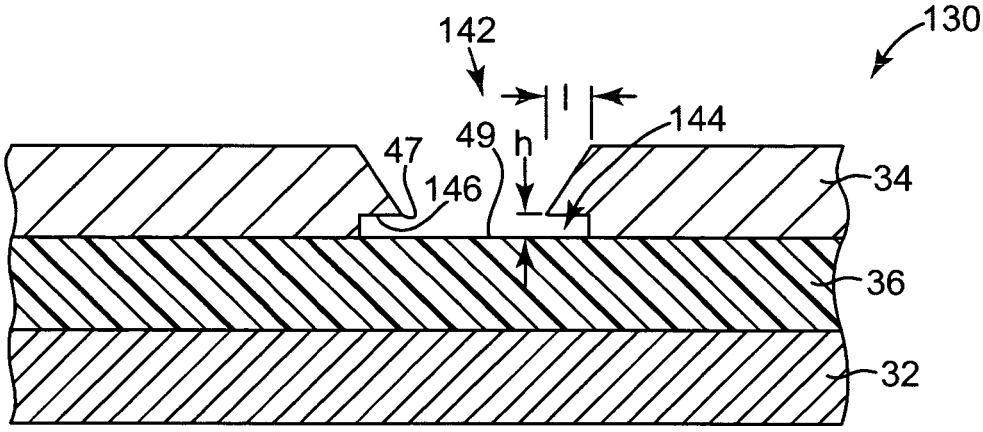
FIGS. 5A-5C are schematic cross-sectional representations of embodiments of charge production sites of a print head according to the invention.
Figure 5B:
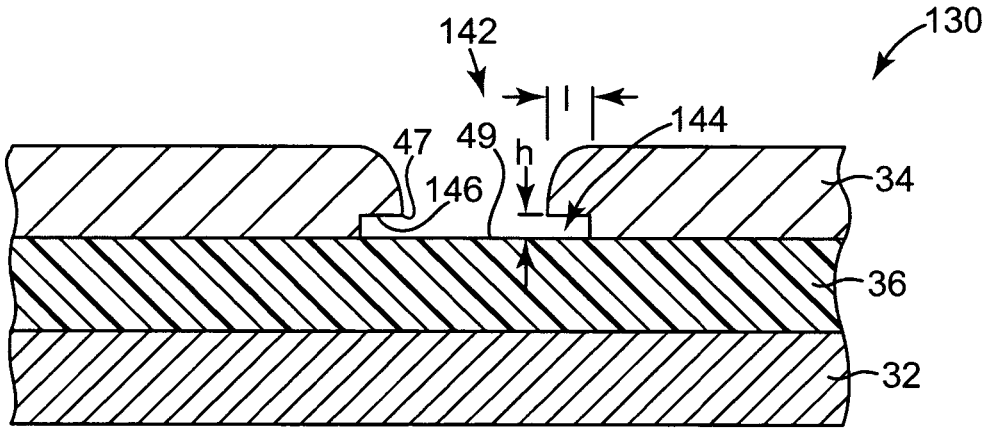
Figure 5C:
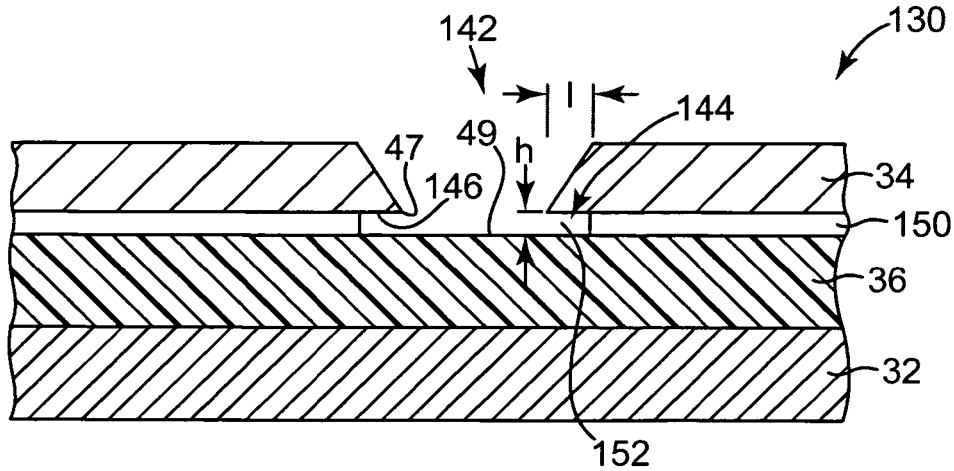

Referring now to FIGS. 5A-5C, cross-sections of a discharge aperture 142 in a single charge production site of a charge deposition print head 130 according to embodiments of the present invention are illustrated. Screen electrode 38 and spacer layer 40 are not shown for purposes of clarity. Discharge apertures 142 are substantially circular and may have a conical taper (shown, for example, in FIGS. 5A and 5C), or may have other shapes including flared or curved shapes (shown, for example, in FIG. 5B) in which the wall angle varies with distance from the insulating layer 36. The discharge apertures 142 of charge deposition print heads 130 address deficiencies of prior art print heads (i.e., inability to print small dots and poor uniformity). Specifically, the print heads 130 employ a discharge aperture 142 geometry that is arranged to provide a region 144 where the external (in air) field lines between the generator and discharge electrodes 32, 34, respectively, are perpendicular, or substantially perpendicular, to the surface 49 of the insulating layer 36. In particular, undercut region 144 defines a discharge surface 146 of discharge electrode 34 that is parallel, or substantially parallel, to and spaced from the surface 49 of insulating layer 36. This undercut geometry at region 144 provides the highest external electric field strength.

The preferred spacing distance or gap h between the undercut surface 146 of the discharge electrode 34 and the opposed surface 49 of the insulating layer 36 is the Paschen minimum of 4 microns at atmospheric pressure. A different preferred distance h will exist if the print head 130 is operated at an ambient pressure other than atmospheric pressure. For example, operating at higher ambient pressures moves the Paschen minimum to a smaller preferred gap. Thus, each ambient pressure at which the print head 130 is intended to operate has a corresponding preferred distance h between the undercut discharge surface 146 and the opposed surface 49 of the insulating layer 36. The distance h between the undercut discharge surface 146 and the surface 49 of the insulating layer 36 is selected based on the intended ambient pressure in which the print head 130 will operate.

At a spacing distance h smaller than the optimal for the operating pressure, field emission may occur but there is insufficient space to start the avalanche continuous discharge. At a larger spacing distances, higher initiation voltages are required. At the 4 micron spacing distance, initiation voltages as low as 500 volts have been observed employing discharge aperture 142 diameters as small as 22 microns, i.e., a diameter smaller than the thickness of the insulating layer 36. In addition, observation indicates that all discharge apertures 142 ignite within a range of about 40 volts.

In one embodiment, the length l of the undercut region 144 is approximately equal to or greater than the spacing distance h of undercut region 144. Thus if the undercut region 144 employs a 4 micron spacing distance h, the undercut surface 146 extends at least about 4 microns substantially parallel to the surface 49 of the insulating layer 36. A longer undercut surface 146 can be employed, but this may lead to the waste of excitation power and further may reduce print head life through overheating.

The undercut geometry of the discharge apertures 142 as illustrated in FIGS. 5A-5C may be provided in any suitable manner. For example, undercutting of the discharge electrode 142 in FIGS. 5A and 5B may be achieved by successive chemical etchings using materials and techniques known in the printed circuit art. In another embodiment, as illustrated in FIG. 5C, a spacer layer 150 is provided between discharge electrode 34 and the insulating layer 36. Spacer layer 150 includes apertures 152 that are larger than and coaxially aligned with discharge apertures 142, such that undercut region 144 is formed between discharge electrode 34 and insulating layer 36. Spacer layer 150 may be formed, for example, of an insulator or a metal foil. In one embodiment, the spacer layer 150 comprises an etched photoresist film. For the case of a print head 130 to be operated at atmospheric pressure, the spacer layer 150 is 4 micron thick.

In another embodiment, the undercut geometry of the discharge apertures 142 as illustrated in FIGS. 5A-5B is achieved by use of a stepped mandrel when electroformed discharge electrodes 34 are employed. For example, the electroforming process as described in U.S. Pat. No. 4,733,971, titled "Thin Film Mandrel," commonly assigned herewith, and incorporated herein in its entirety by reference, controls the undercut spacing distance h in region 144 through the selection of a suitable stepped mandrel. Electroforming beneficially allows the manufacture of small (down to about 13 μm diameter) discharge apertures 142 with a repeatable breakdown geometry due to control over the spacing distance h of the undercut in region 144 and creation of a sharp edge or corner 47 around the entire perimeter of the apertures 142. The presence of a sharp edge or corner 47 around the entire perimeter of the apertures 142 increases the probability of a discharge event starting once the Paschen curve minimum voltage is reached.

Figure 6:
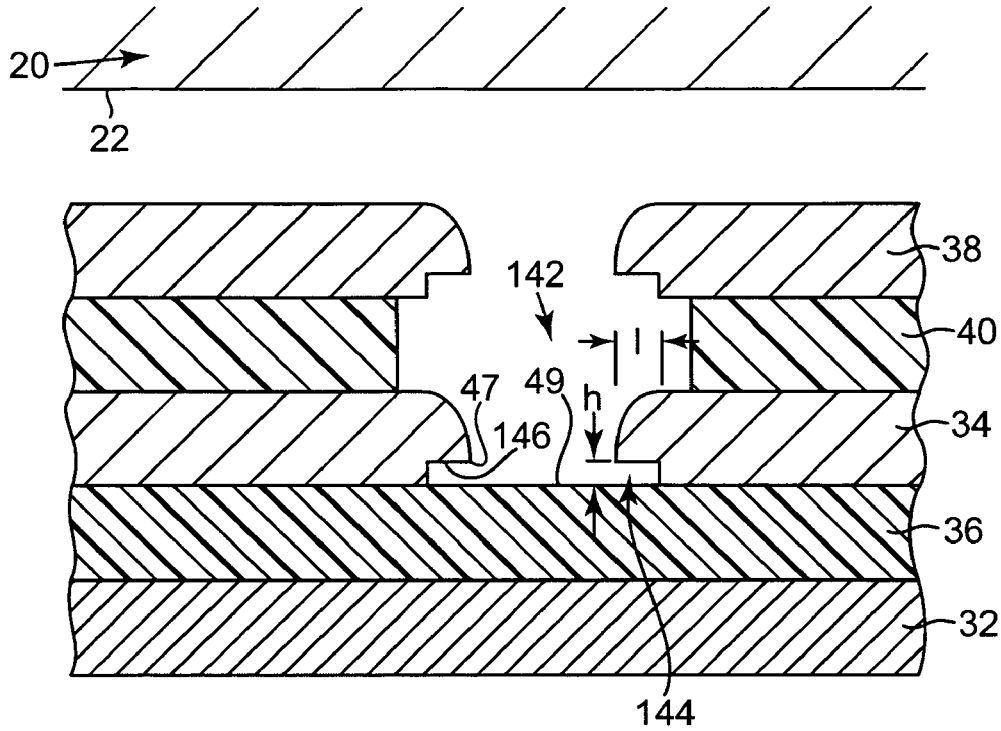
FIG. 6 is a schematic cross-sectional representation of a charge production site of a print head according to another embodiment.

FIG. 6 illustrates a print head 130 built using electrodes that have been electroformed. The discharge electrode 34 has an undercut region 144 with a spacing distance or gap h that can be specified to be the Paschen minimum for the intended operating pressure of the print head 130. The screen electrode 38 is used for further focusing the beam of charged particles and is biased at a different voltage than the generator and discharge electrodes 32, 34, respectively. The electroform process yields flexibility in controlling the spacing distance h of the undercut surface 146 above surface 49 of insulating layer 36, and further provides a sharp corner 47 about the perimeter of aperture 142 extending through the discharge electrode 34, thereby permitting optimization of the aperture 142 geometry for the intended operating environment (e.g., smaller undercut gap h for operating at higher than atmospheric pressures). Operating at higher than atmospheric pressures provides an advantage of increasing the breakdown voltage between the screen electrode 38 and imaging surface 22, which allows for narrow focusing of the charge beam.

Figure 7:
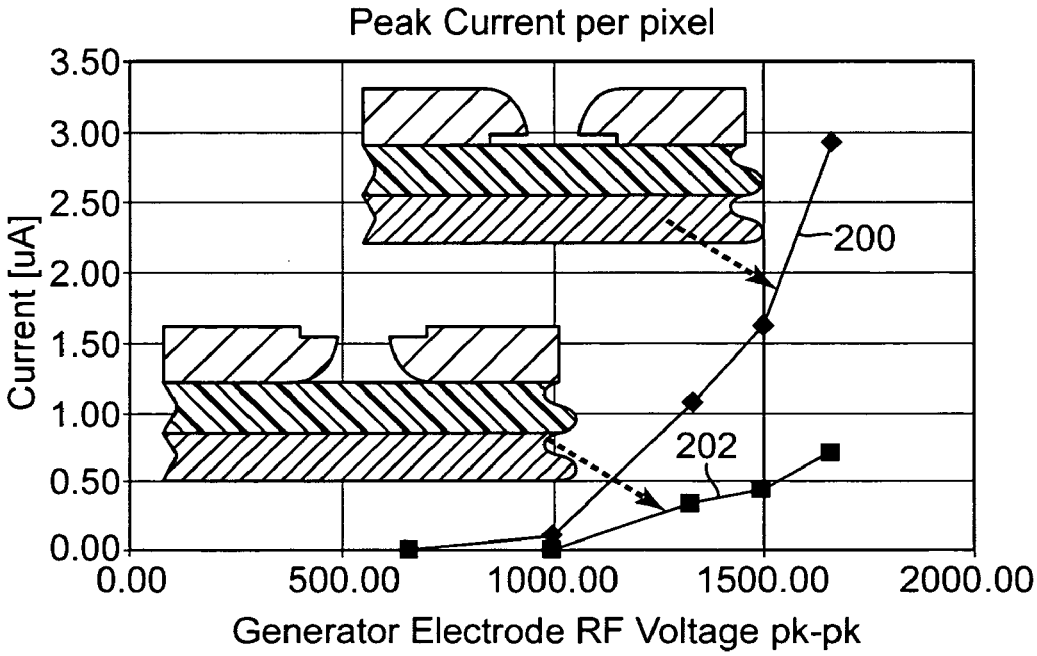
FIG. 7 is a graph of output current illustrating the effect of discharge aperture geometry on print head performance.

FIG. 7 illustrates the large effect of discharge aperture geometry on print head performance. In particular, FIG. 7 shows measured output current for a single layer (discharge electrode only; no screen electrode) print head for two different discharge electrode configurations. Curve 200 shows a configuration having an undercut discharge electrode 34 as illustrated in FIG. 5B, where the sharp corner and undercut step face toward the insulating layer 36. Curve 202 shows a configuration in which the orientation of discharge electrode 34 of FIG. 5B has been reversed by turning the electrode upside down, such that the sharp corner and undercut step face away from the insulating layer 36. In this example, the output current shown by curve 200 is approximately four times greater that the output current shown by curve 202.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. For example, for purpose of clarity, exemplary implementations having specific dimensions, voltages, materials, and process parameters are illustrated and described herein. However, the invention is understood to be applicable and useful with implementations having dimensions, voltages, materials, and process parameters different than those described herein. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A print head for use in an electrostatic imaging process, the print head comprising:

a first electrode layer including a plurality of generator electrodes;

a second electrode layer including a plurality of discharge electrodes; and an insulating layer disposed between the generator electrodes of the first electrode layer and the discharge electrodes of the second electrode layer;

wherein each of the plurality of discharge electrodes includes at least one discharge aperture extending therethrough, the at least one discharge aperture having an undercut region forming an overhanging portion defining a discharge surface spaced from and substantially parallel to an opposed surface of the insulating layer.

2. The print head of claim 1, wherein the discharge surface of the discharge electrode and the opposed surface of the insulating layer are arranged to generate electric field lines that are substantially perpendicular to the opposed surface of the insulating layer.

3. The print head of claim 1, further comprising a screen electrode spaced from the second electrode layer by an insulative spacer layer, the screen electrode having openings extending therethrough, wherein the openings of the screen electrode are aligned with corresponding ones of the discharge apertures of the plurality of discharge electrodes.

4. The print head of claim 1, wherein the discharge surface of the discharge electrode is spaced from the opposed surface of the insulating layer by a distance of approximately 4 microns.

5. The print head of claim 1, wherein the undercut region extends about an entire periphery of the at least one discharge aperture of each of the plurality of discharge electrodes.

6. The print head of claim 1, wherein the at least one discharge aperture of each of the plurality of discharge electrodes is substantially circular.

7. The print head of claim 6, wherein the at least one discharge aperture of each of the plurality of discharge electrodes has a diameter of less than about 150 microns.

8. The print head of claim 6, wherein the at least one discharge aperture of each of the plurality of discharge electrodes has a diameter of less than a thickness of the insulating layer.

9. The print head of claim 1, wherein a length of the discharge surface parallel to the insulating layer is approximately equal to or greater than the spacing of the discharge surface from the insulating layer.

10. The print head of claim 1, wherein the undercut region defines a sharp edge extending about the periphery of the discharge aperture.

11. The print head of claim 1, further comprising a spacer layer positioned between the discharge electrode and the insulating layer, the spacer layer having a spacer aperture larger than the discharge aperture, wherein the spacer aperture and the discharge aperture are coaxially aligned to define the undercut region of the discharge aperture.

12. The print head of claim 1, wherein the print head is configured to operate in one of a plurality of ambient pressures, each of the plurality of ambient pressures having a corresponding preferred distance between the discharge surface and the opposed surface of the insulating layer, and wherein the discharge surface is spaced from the opposed surface of the insulating layer by the preferred distance corresponding to the one of the plurality of ambient pressures.

13. An image transfer device comprising:

an imaging member including an outer imaging surface;

a charge deposition print head including a generator electrode on a first side of an insulating layer and a discharge electrode on a second side of the insulating layer, wherein the discharge electrode includes at least one discharge aperture extending therethrough, the at least one discharge aperture having an undercut region forming an overhanging portion defining a discharge surface spaced from and substantially parallel to the second side of the insulating layer;

wherein the print head is configured to direct a stream of charge carriers from the at least one discharge aperture to the imaging surface and thereby form an electrostatic latent image on the imaging surface.

14. The image transfer device of claim 13, wherein the imaging member is configured to move the imaging surface past the print head.

15. The image transfer device of claim 13, further comprising:

a development station configured to develop the electrostatic latent image on the imaging surface using a marking agent.

16. The image transfer device of claim 15, further comprising:

a transfer apparatus configured to transfer the marking agent of the developed image from the imaging surface to a print media.

17. A method of manufacturing a print head for use in an electrostatic image transfer device, comprising:

providing a first electrode layer including a plurality of generator electrodes on a first surface of an insulating layer;

providing a second electrode layer including a plurality of discharge electrodes on a second, opposite surface of the insulating layer; and forming at least one discharge aperture in each of the plurality of discharge electrodes, wherein the at least one discharge aperture includes an undercut region forming an overhanging portion defining a discharge surface spaced from and substantially parallel to the second surface of the insulating layer.

18. The method of claim 17, wherein the undercut region extends about an entire periphery of the at least one discharge aperture of each of the plurality of discharge electrodes.

19. The method of claim 18, wherein the undercut region further defines a sharp edge extending about the entire periphery of the discharge aperture.

20. The method of claim 17, wherein forming at least one discharge aperture in each of the plurality of discharge electrodes comprises electroforming the discharge electrodes with a stepped mandrel.

21. The method of claim 17, wherein forming at least one discharge aperture includes positioning a spacer layer between the discharge electrode and the insulating layer, the spacer layer having a spacer aperture larger than the discharge aperture, wherein the spacer aperture and the discharge aperture are coaxially aligned to define the undercut region of the discharge aperture.

22. The method of claim 17, wherein forming at least one discharge aperture includes selecting a distance between the discharge surface and the second surface of the insulating layer based on an intended ambient pressure in which the print head will operate.

* * * * *

UNITED STATES PATENT AND TRADEMARK OFFICE

CERTIFICATE OF CORRECTION

PATENT NO. : 7,623,144 B2
APPLICATION NO. : 11/699720
DATED : November 24, 2009
INVENTOR(S) : Richard Fotland et al.

It is certified that error appears in the above-identified patent and that said Letters Patent is hereby corrected as shown below:

On the face page, in field (75), Inventors, in column 1, line 3, delete "Napolean" and insert -- Napoleon --, therefor.

Signed and Sealed this

Twentieth Day of April, 2010

David J. Kappos

David J. Kappos
*Director of the United States Patent and Trademark Office*